US007751647B2

(12) United States Patent
Pikaz

(10) Patent No.: US 7,751,647 B2
(45) Date of Patent: Jul. 6, 2010

(54) SYSTEM AND METHOD FOR DETECTING AN INVALID CAMERA IN VIDEO SURVEILLANCE

(75) Inventor: Arie Pikaz, Givatayim (IL)

(73) Assignee: Lenel Systems International, Inc., Pittsford, NY (US)

( * ) Notice: Subject to any disclaimer, the term of this patent is extended or adjusted under 35 U.S.C. 154(b) by 0 days.

(21) Appl. No.: 12/086,063

(22) PCT Filed: Dec. 8, 2006

(86) PCT No.: PCT/US2006/046806

§ 371 (c)(1),
(2), (4) Date: Feb. 20, 2009

(87) PCT Pub. No.: WO2007/067722

PCT Pub. Date: Jun. 14, 2007

(65) Prior Publication Data

US 2009/0212946 A1 Aug. 27, 2009

Related U.S. Application Data

(60) Provisional application No. 60/748,540, filed on Dec. 8, 2005.

(51) Int. Cl.
*G06K 9/64* (2006.01)

(52) U.S. Cl. ..... 382/278; 382/209; 382/224; 348/47; 348/135; 348/143

(58) Field of Classification Search ..... 382/209, 382/219, 278

See application file for complete search history.

(56) References Cited

U.S. PATENT DOCUMENTS 5,519,669 A 5/1996 Ross et al.

(Continued)

FOREIGN PATENT DOCUMENTS

WO WO 2005/109186 A3 11/2005

OTHER PUBLICATIONS

Harris et al., A Combined Corner and Edge Detector, Proc. Fourth Alvey Vision Conf., vol. 15, pp. 147-151, 1988.

(Continued)

*Primary Examiner*—Yosef Kassa
(74) *Attorney, Agent, or Firm*—Kenneth J. Lukacher

(57) ABSTRACT

A system having a camera (18) for capturing video images of a scene in successive image frames, and a computer system (14 or 20) for receiving such video images. The computer system periodically generates a background image of the scene from multiple successive image frames (23) and extracts features in the background image (26), and extracts features for each new image frame received from the camera (28). For each new image frames, the new image frame and the last periodically generated background image are correlated at common locations (parts or regions) associated with the features extracted from the last periodically generated background image and features of the new image frame (30), to determine non-correlated features in the new image frame with respect to the last periodically generated background image (31). If the number and/or percentage of non-correlated features are sufficiently high, and/or the spatial distribution of non-correlated features is sufficiently low, the image frame is determined to have an invalid background (32, 33). When multiple successive frames are determined as having invalid backgrounds, the camera (20) represents an invalid camera.

22 Claims, 4 Drawing Sheets

U.S. PATENT DOCUMENTS

| | | | | |
|---|---|---|---|---|
| 5,587,740 | A | 12/1996 | Brennan | |
| 5,801,770 | A | 9/1998 | Paff et al. | |
| 6,233,588 | B1 | 5/2001 | Marchoili et al. | |
| 6,509,926 | B1 | 1/2003 | Mills et al. | |
| 6,738,772 | B2 | 5/2004 | Regelski et al. | |
| 6,989,842 | B2 * | 1/2006 | Cropper et al. | 345/629 |
| 7,106,374 | B1 * | 9/2006 | Bandera et al. | 348/308 |
| 7,227,893 | B1 * | 6/2007 | Srinivasa et al. | 375/240.08 |
| 7,529,411 | B2 * | 5/2009 | Haupt et al. | 382/220 |
| 2005/0183128 | A1 | 8/2005 | Assayag et al. | |

OTHER PUBLICATIONS

Lenel Systems International, Inc., Brochure Entitled: Lenel IntelligentVideo for OnGuard VideoManager, 2005.

Gonzalez, R.C. et al., Digital Image Processing, Addison-Wesley Publishing Company, Inc., New York, Section 9.3, 1993.

* cited by examiner

SYSTEM AND METHOD FOR DETECTING AN INVALID CAMERA IN VIDEO SURVEILLANCE

This application claims the benefit of priority to U.S. Provisional Patent Application No. 60/748,540, filed Dec. 8, 2005, which in herein incorporated by reference.

FIELD OF THE INVENTION

The present invention relates to a system and method for detecting an invalid camera in video surveillance, and particularly to a system and method for detecting an invalid camera by the occurrence of a significant change in the background of a scene under surveillance by such camera. This invention is especially useful for determining when a camera has been moved or covered, either accidental or intentional, so that corrective action may be taken by security personnel. When a camera is not properly viewing of a scene under video surveillance it is referred to as an invalid camera.

BACKGROUND OF THE INVENTION

Video surveillance often utilizes video cameras for viewing a scene, such that video images from the scene can be recorded and/or provided to displays monitored by security personnel. One problem is that when a video camera is accidental moved or covered (or intentional tampered with) the camera can become an invalid camera as it is no longer properly viewing the intended scene under surveillance, and can thus pose a security risk. Traditionally, video surveillance relies on security personnel to identify the occurrence of an invalid camera, but such reliance can cause delay when security personnel are not actively engaged in video monitoring, or are viewing a large number of video displays simultaneously at a workstation or console. The sooner an invalid camera is detected the lower the risk that video surveillance, and security provided by such surveillance, can be compromised.

SUMMARY OF THE INVENTION

Accordingly, it is a feature of the present invention to provide a system for enabling automatic analysis of video images from a video camera to detect when such camera represents an invalid camera.

Briefly described, the present invention embodies a system having a camera for capturing video images of a scene in successive image frames, and a computer system for receiving such video images. The computer system periodically learns a background image of the scene from a plurality of successive image frames and extracts feature points (or locations) in the background image, and for each new image frame received from the camera extracts feature points in the new image frame. Each of the features points extracted from the background image and the new image are correlated with each other with respect to a region at the same positional location in the two images centered about feature point to determine whether each feature point represents a correlated or non-correlated feature. When the number of non-correlated feature points between the two images is above a first threshold level, the percentage of non-correlated features is above a second threshold level, and/or the spatial distribution of non-correlated feature points is below a third threshold level, the image frame is determined as having an invalid background. When multiple successive frames are determined as having invalid backgrounds, the camera represents an invalid camera.

The present invention also describes a method for detecting when a camera is an invalid camera having the steps of: periodically generating a background image from successive image frames from the camera; extracting first features from the background image; extracting second features from new image frames from the camera; correlating, for each of the new image frames, at common locations (parts or regions) in the new image frame and the last periodically generated background image, in which the locations are associated with the first features extracted from the last periodically generated background image and second features of the new image frame, to determine non-correlated features in the new image frame with respect to the last periodically generated background image; and determining the camera as representing an invalid camera in accordance with one or more of the number, percentage, or spatial distribution of the non-correlated features in a plurality of ones of the new images.

BRIEF DESCRIPTION OF THE DRAWINGS

The foregoing features and advantages of the invention will become more apparent from a reading of the following description in connection with the accompanying drawings, in which.

DETAILED DESCRIPTION OF INVENTION

Figure 1:
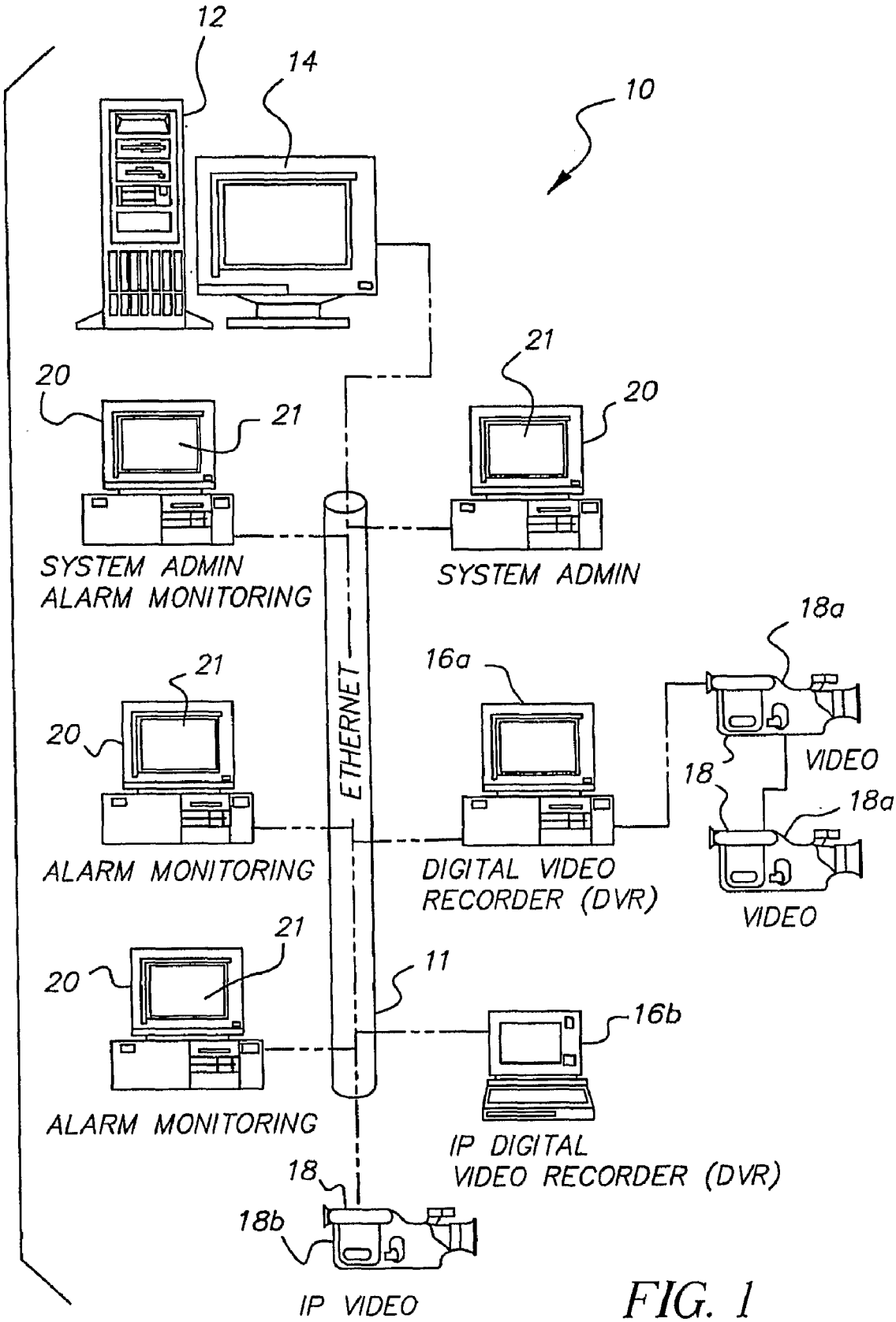
FIG. 1 is a block diagram of a network connecting computer systems to video cameras via their associated digital recorders.

Referring to FIG. 1, a system 10 is shown having a computer system or server 12 for receiving video image data from one or more digital video recorders 16*a* and 16*b* via a network (LAN) 11. The digital video recorders 16*a* and 16*b* are each coupled to one or more video cameras 18, respectively, for receiving and storing images from such cameras, and transmitting digital video data representative of captured images from their respective cameras to the computer server 12 (or to one or more computer workstations 20) for processing of video data and/or outputting such video data to a display 14 coupled to the computer server (or a display 21 coupled to workstations 20). One or more computer workstations 20 may be provided for performing system administration and/or alarm monitoring. The number of computer workstations 20 may be different than those shown in FIG. 1. The workstations 20, server 12, digital video recorders 16*a* and 16*b*, communicate via network 11, such by Ethernet hardware and software, for enabling LAN communication.

The digital video recorders may be of one of two types, a digital video recorder 16*a* for analog-based cameras, or an IP network digital video recorder 16*b* for digital-based cameras. Each digital video recorder 16*a* connects to one or more analog video cameras 18*a* for receiving input analog video signals from such cameras, and converting the received analog video signals into a digital format for recording on the digital storage medium of digital video recorders 16*a* for storage and playback. Each IP network digital video recorder 16*b* connects to IP based video camera 18*b* through network 11, such that the cameras produces a digital data stream which is captured and recorded within the digital storage medium of the digital video recorder 16*b* for storage and playback. The digital storage medium of each digital video recorders 16*a* and 16*b* can be either local storage memory internal to the digital video recorder (such as a hard disk drive) and/or memory connected to the digital video recorder (such as an external hard disk drive, Read/Write DVD, or other optical disk). Optionally, the memory storage medium of the digital video recorder can be SAN or NAS storage that is part of the system infrastructure.

Typically, each digital video recorder 16*a* is in proximity to its associated cameras 18*a*, such that cables from the cameras connect to inputs of the digital video recorder, however each digital video recorders 16*b* does not require to be in such proximity as the digital based cameras 18*b* connect over network 11 which lies installed in the buildings of the site in which the video surveillance system in installed. For purposes of illustration, a single digital video recorder of each type 16*a* and 16*b* is shown with one or two cameras shown coupled to the respective digital video recorder, however one or more digital video recorders of the same or different type may be present. For example, digital video recorders 16*a* may represent a Lenel Digital Recorder available from Lenel Systems International, Inc., or a M-Series Digital Video Recorder sold by Loronix of Durango, Colo., digital video recorder 16*b* may represent a LNL Network Recorder available from Lenel Systems International, Inc., and utilize typical techniques for video data compression and storage. However, other digital video recorders capable of operating over network 11 may be used. Also, camera 18*b* may send image data to one of the computer 12 or 20 for processing and/or display without use of a digital video recorder 16*b*, if desired.

The system 10 may be part of a facilities security system for enabling access control in which the network 11 is coupled to access control equipment, such as access controllers, alarm panels, and readers, and badging workstation(s) provided for issuing and managing badges. For example, such access control system is described in U.S. Pat. Nos. 6,738,772 and 6,233,588. Video cameras 18 are installed in or around areas of buildings, underground complexes, outside buildings, or remote location to view areas such as for video surveillance. Groups of one or more of the video cameras 18*a* and 18*b* are each coupled for data communication with their respective digital video recorder. One or more of the cameras may be part of a monitoring system to a workstation 20 for enabling security personal to view real-time images from such camera. The following discussion considers a single camera 18 providing images, via its associated DVR 16*a* or 16*b* (or directly without a DVR), to one of the computers 14 and 20 which has software (or program) for checking video image from the cameras to detect whether the camera has become an invalid camera. Such computer may be considered a computer server. The operation of the system and method can be carried out on multiple cameras 18 in system 10.

Figure 2:
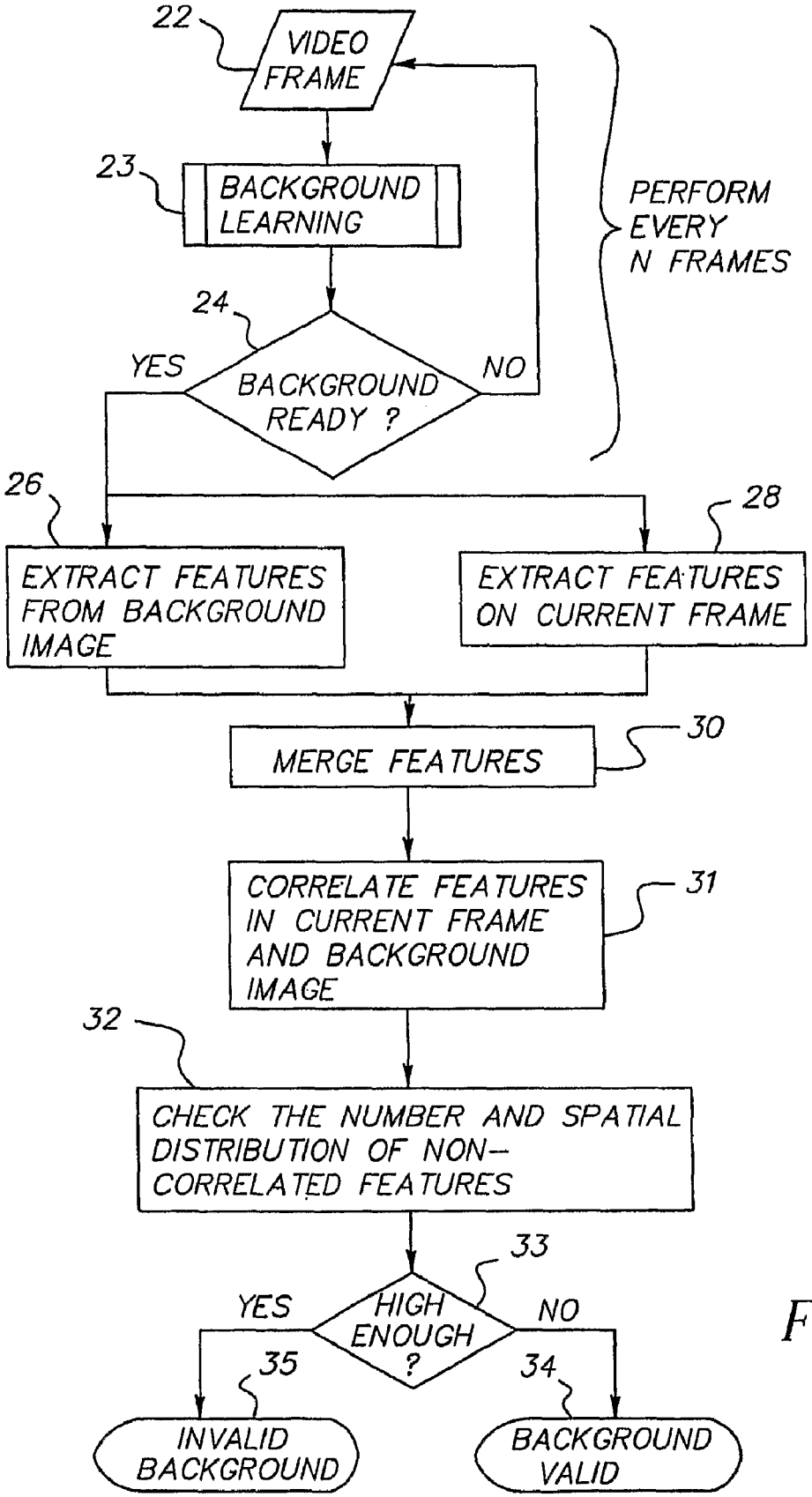
FIG. 2 is a flow chart showing the process carried out in software in one of the computer system of FIG. 1 using video image frames received from a surveillance camera in accordance with the present invention.

FIG. 2 is a flowchart of the process carried out by the software (program or application) in one of computers 14 and 20 of FIG. 1 for enabling detection of an invalid camera in video images of a scene captured by a camera by detecting when there is a significant change in the background of the scene, which means that the camera was moved or covered. Such video images from the camera represent successive video image frames, in which each image frame represents a two-dimensional x,y array of pixels having values (such as gray-scale value). For each new video image frame for the camera (step 22), a background of the scene is learned (step 23). A background image is created by a learning process over a minimal number N of consecutives frame (can be over few minutes of video). The background image is created by a clustering process for each image pixel over the population of pixel values in the sequence of frames. The background value for each pixel in the background image represents the pixel value of the biggest cluster for that pixel. Thus each pixel has N number of values over N frames, and these N values are grouped into clusters of different ranges (e.g., 4 clusters), the mean value of the cluster having the largest number of the N values is the selected background value of that pixel. The background image is periodically updated by performing step 23 on another set of N consecutive frames and replacing the previous background image with the new one that was built based on the last N consecutive frames. Once each background is generated, it is stored in memory of the computer and thereafter used as described below until it is replaced with a new background image.

Each image frame (and respectively the background image) can optionally be scaled to some pre-determined size. For example, such size can be "CIF resolution" (352×240 pixels). It is useful both to accelerate the computation (in case of input frame size which is bigger than CIF) and normalize the thresholds, which are described below.

When the background image is ready (step 24), the features are extracted from the background image (step 26). Feature extraction of an image represents identification of feature points in the image associated with corners, edges, or boundaries of objects. For example, the Harris Corner Detection method may be applied to the image to identify the feature point, such as described in C. Harris and M. Stephens, "A Combined Corner and Edge Detector," Proc. Fourth Alvey Vision Conf., Vol. 15, pp. 147-151, 1988, but other methods may also be used. The feature points (or locations) extracted from the background image are stored as a list of image coordinates (x,y) in memory of the computer, such that they are available for subsequent processing. After the background image is generated, each new image received by the camera thereafter from the computer has it feature points (or locations) extracted and stored as a list of coordinates (x,y) in memory of the computer (step 28).

The extracted features of the background image and the current image are merged by combining their respective lists of feature points (step 30), and then the feature points are used to determine whether parts of the background image and current image have pixel values that correlate or not to each other at and about each feature point (step 31). Each of the features points extracted from the background image and the new image are correlated with each other with respect to a region at the same positional location (common locations) in the two images centered about feature point to determine whether each feature point represents a correlated or non-correlated feature. For example, for each feature point on the merged list, a normalized correlation of window of size M×M around the feature (or other matching scheme) is used to provide a matching score. For example, M may equal 5 to 10 pixels, but other values may be used. For example, normalized correlation is described for example in Gonzalez, Rafael C. and Woods, Richard E., Digital Image Processing, Addison-Wesley Publishing Co., Massachusetts, Section 9.3, Page 583, 1993. All the features points with a matching score below a pre-defined threshold are stored in an array (each feature represented by its x,y coordinates) providing a list of non-matching (or non-correlated) features. Those at or above the pre-defined threshold are stored in an array (each feature represented by its x,y coordinates) providing a list of matching (or correlated) features. The pre-defined threshold is stored in memory of the computer. The matching score represents a value between −1 and 1, where 1 represents a perfect match. The pre-defined correlation threshold may be, for example, a value between 0.6 to 0.8, as desired by the user.

The number and spatial distribution of the coordinates of the non-correlated features is then checked as follows (step 32). Using second order statistics, the distribution is measured based on the difference in the probability of having two non-correlated features in distance X to having two non-correlated features in a distance Y, where Y is very small (e.g., Y=2), and X is relatively larger (e.g., X=10). If the (i) number of non-correlating features is above a pre-defined threshold value, (ii) the percentage of non-correlating features is above the user-defined parameter "sensitivity" adjustable by the below described user interface, and (iii) the difference in the relative frequency of "close" and "distant" non-correlated features (as measured with the distances X and Y) is below a pre-defined threshold (step 33), then the current video frame is determined as having an invalid background (step 35), otherwise the background in valid (step 34). The threshold value of the number of non-correlating features is a stored value in memory of the computer (for example, such value may be 60, but other threshold values may be used as desired by the user).

The percentage of non-correlating features represents the percentage of the ratio of the number of x,y coordinates stored in the array of non-matching features to the total number of x,y coordinates stored from the array of non-matching features plus the array of matching features.

Threshold frequency value is a stored value in memory of the computer (for example, the threshold frequency value may be 0.2, but other threshold values may be used as desired by the user). In other words, the background established when the camera was located in a proper position for viewing the scene is inconsistent with the background of the current image frame. Less preferably, the determination of an invalid background may be made by satisfying one or any two of the above three (i), (ii) and (iii) criteria.

For each frame, steps 28, 30, 31, 32, and 33 are performed using the last periodically determined background image and its extracted features of step 26. If a sequence of consecutive frames over K seconds (for example, K can be 6 seconds) were detected by the computer as having an "Invalid Background", an alarm of "Invalid Camera" is generated by the computer. The event is logged at the computer and may be communicated to other computer 14 and 20 over network 11 (FIG. 1). An invalid camera likely occurs when the camera has moved (i.e., change of view) or covered (i.e., partially or completely blocking the scene). Thus, the condition of an invalid camera can be identified quickly so that security personal can take corrective action. Further, the invalid camera detection adapts to changes in lighting conditions in the scene, since the normalize correlation of features is insensitive to changes in lighting, and the background image is periodically updated (e.g., every 5 to 15 minutes, but other periodic interval may be used as desired by the user).

Figure 3:
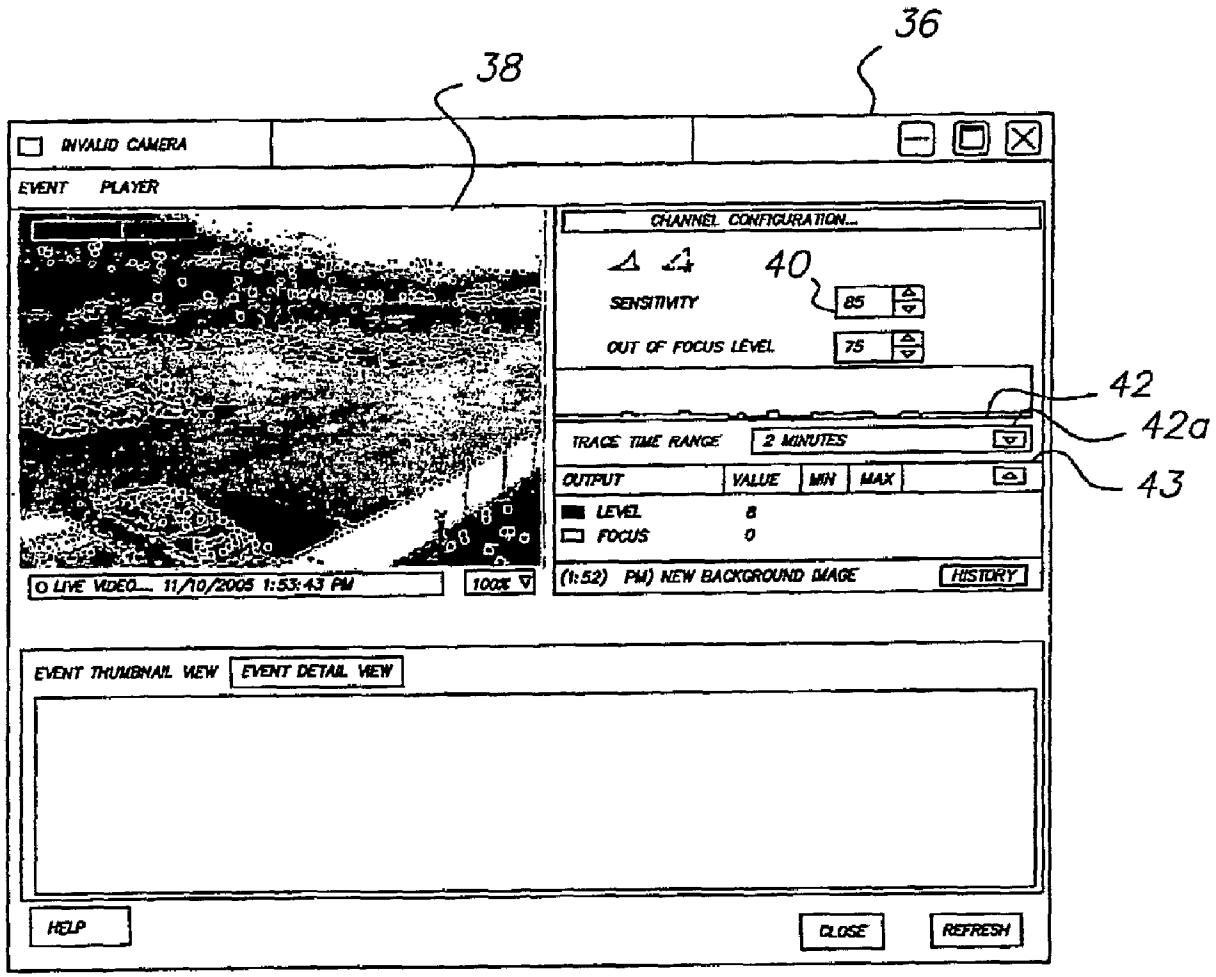
FIGS. 3 and 3A are examples of a user interface for inputting user parameters in accordance the present invention and for viewing in a diagnostic mode of correlated and non-correlated features between a background image and a current image frame.

FIG. 3 shows a graphical user interface 36 on the computer carrying out the software or program for invalid camera detection of FIG. 2. The interface has a window 38 showing one of the real-time video image or the background image. The user interface when operated in a Diagnostics Mode, as shown for example in FIG. 3, shows the marked feature point upon the current image, where dark dots represent non-correlated feature point with the background, and gray dots correlated feature points with the background image.

When cameras have a variable focus setting, it is possible that an invalid background may be associated with the camera going out of focus, but similarly would require attention of security personnel to investigate and correct the condition. Images from the camera may also be analyzed for detection of out-of-focus condition, however, such detection is outside the scope of the present invention, but may be provided on the same interface of FIG. 3. For example, typically software may be also used to detect when images from a camera are out of focus. Accordingly, parts of the interface to such out-of-focus detection are not described herein.

A field 40 in the user interface allows the user to set the sensitivity for detecting an invalid camera (see step 33). The sensitivity level is a number from 0 to 100, which is the percentage of the non-correlated features from the total number of features. Optionally, the sensitivity level may be the truncated number of non-correlated features, scaled to fit to the range 0 to 100. For example, the number of non-correlated features can be truncated to 500 (if it is greater that 500 it is considered as 500) and then scaled down by a factor of 5 to fit the 0 to 100 range. Other upper values may be used. When such optional sensitivity level is used, the value determined by the computer and checked against criteria (ii) at step 33 is likewise truncated (if needed) and scaled such that it can be compared to the user selected sensitivity level. Although the user interface is shown to enable the user to select the threshold level of criteria (ii) additional fields may be provided to enable user to select one or both of the thresholds of criteria (i) and (iii).

The computer records in its memory for each frame the actual number of non-correlated features detected. A graphic 42 displays the history of level of invalid background image detections, where the graphic may be line where the height of the line is proportional to the number of non-correlated features detected for each of the frame for the time range shown below graphic 42. For example, the time range may be 2 minutes, but other time value may be selected by the user in field 42*a*, whereby if changed, the computer updates graphic 42 accordingly. The interface also has an output window 43 providing a display of the level of Sensitivity for the Invalid Camera that should be set in order to generate an Invalid Camera alarm. The level of Sensitivity relates to the K period of time (related to the number of image frames having invalid background) used to determine when an invalid camera is detected.

Figure 3A:
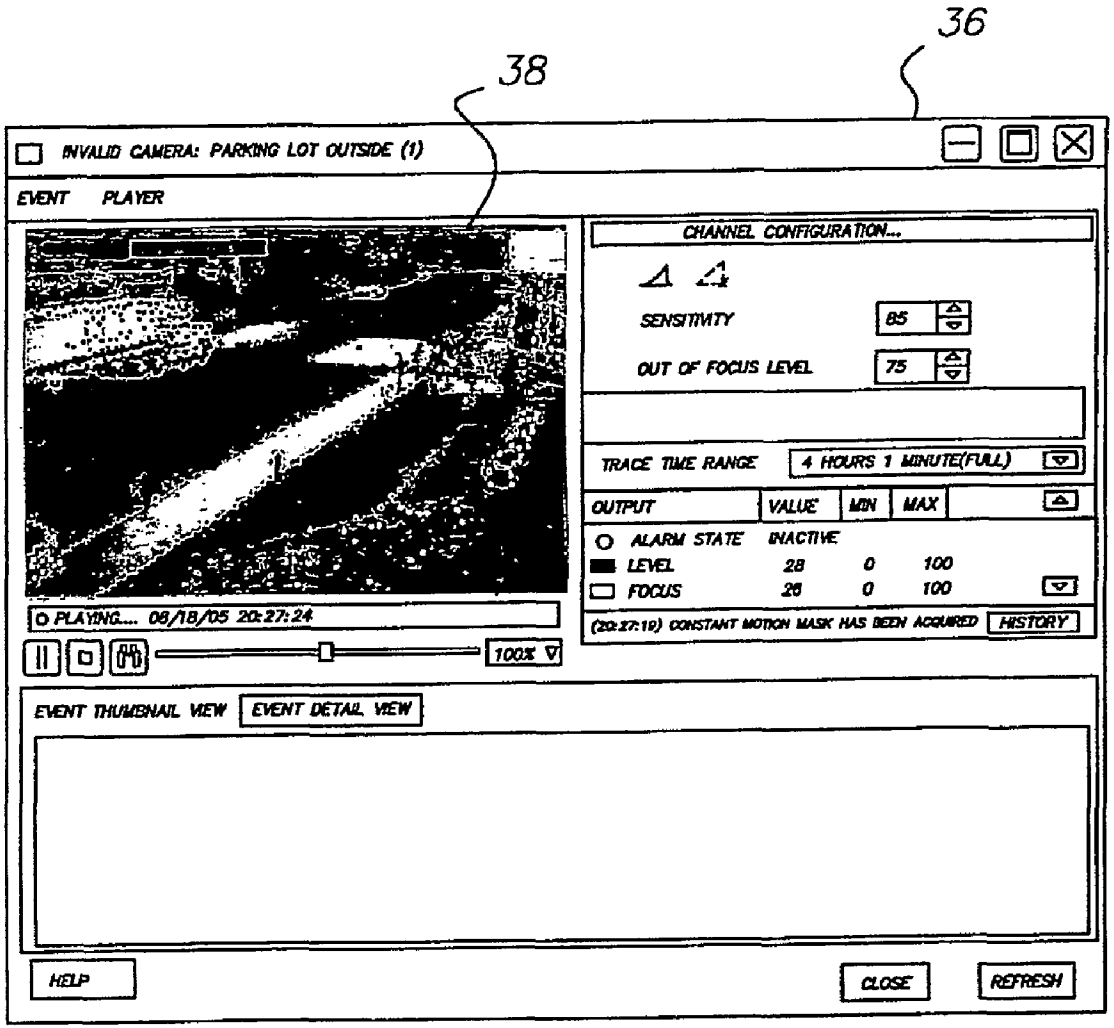

FIG. 3A shows another example of the user interface of FIG. 3, in which the moving truck is indicated as having non-correlated feature points while the surrounding scene had correlated feature points. The user interface in addition to enabling setting up of the parameters of operation also provides a diagnostics view showing the internal process of the merged marked images. Typically, the user can view the results of the output window and the current image frame from the camera, but can switch to a diagnostic mode to view color coded coordinates distinguishing coordinates of the correlation feature list and the non-correlation feature list upon the current frame. Although external video surveillance of scenes are show in the examples of FIGS. 3 and 3A, the camera may be located for viewing a scene inside a building for internal video surveillance.

Optionally, the digital video recorder 16 or 16*a* could represent a stand-alone computer coupled to one or more video cameras with the ability to record and process real-time images capability. The user interface and processes of FIG. 2 are carried out by the stand-alone computer in response to image data received to detect invalid camera(s).

From the foregoing description, it will be apparent that there has been provided system, method, and user interface for detecting an invalid camera in video surveillance. Variations and modifications in the herein described system, method, and user interface in accordance with the invention will undoubtedly suggest themselves to those skilled in the art. Accordingly, the foregoing description should be taken as illustrative and not in a limiting sense.

The invention claimed is:

1. A method for detecting when a camera providing video surveillance of a scene in successive image frames is an invalid camera, said method comprising the steps of:

periodically generating a background image from a plurality of said successive image frames from the camera;

extracting first features from the background image;

extracting second features from new image frames from said camera;

correlating, for each of said new image frames, at common locations in the new image frame and the last periodically generated background image, in which said locations are associated with said first features extracted from the last periodically generated background image and second features of the new image frame, to determine non-correlated features in the new image frame with respect to the last periodically generated background image; and determining said camera as representing an invalid camera in accordance with one or more of the number, percentage, or spatial distribution of said non-correlated features in a plurality of ones of said new images.

2. The method according to claim 1 further comprising the step of generating an invalid camera alarm when said camera is determined invalid.

3. The method according to claim 1 wherein said camera determined invalid is associated with one of movement of said camera or at least partial blocking of view of said camera of said scene.

4. The method according to claim 1 wherein said determining step further comprises the step of:

determining for each of said correlated new image frames as having an invalid background in accordance with at least one of the number of said non-correlated features, a percentage of said non-correlated features, or spatial distribution of said non-correlated features of the new image frame; and determining said camera invalid when a number of said plurality of ones of said new image frames are consecutively determined as having invalid background.

5. The method according to claim 4 wherein said step of determining said camera invalid when a number of said plurality of ones of said new images are consecutively determined as having invalid background further comprises the step of:

determining for each of said correlated new image frames as having an invalid background in accordance with at least one of the number of said non-correlated features of the new image frame is above a first threshold, or a percentage of said non-correlated features in the new frame is above a second threshold, or spatial distribution of said non-correlated features is below a third threshold.

6. The method according to claim 5 wherein at least one said first, second, and third thresholds are selectable by a user via a user interface.

7. The method according to claim 1 further comprising the step of:

providing a user interface to view said new image frames from said camera which indicates at least the non-correlated features at least in one of correlated new image frames.

8. The method according to claim 1 wherein each of said image frames is composed of pixels having a value, and said correlating step further comprises the steps of:

determining, for each of said new image frames, a matching score for each of said locations associated with said first features from the background image and said second features of the new image frame by correlating values of pixels in the last periodically generated background image with the values of pixels in the new image frame about a common region associated with the location; and classifying, for each of said new image frames, said first features and second features of the new image as a non-correlated feature by comparing their respective matching score with a threshold score value.

9. The method according to claim 1 wherein said extracted first features represent a location associated with one or more of corners, edges, or boundaries in the scene of said background image, and second features for each of said new images represent a location associated with one or more of corners, edges, or boundaries in the new image.

10. A method for detecting an invalid background in video images of a scene from a camera useful for determining when said camera is invalid, said method comprising the steps of:

(a) generating a background image of the scene from a plurality of said images provided from a camera over a period of time;

(b) extracting feature locations in the background image;

(c) extracting feature locations from one of said images from said camera;

(d) correlating regions of the background image and said one of said images with respect to each of said extracted feature locations from steps (b) and (c) to characterize each of the feature locations as representing a correlated feature or a non-correlated feature in the scene, thereby providing a plurality of correlated features and a plurality of non-correlated features associated with the scene in said one of said images; and (e) determining said one of said image as having an invalid background in accordance with at least one of the number of said non-correlated features, a percentage of said non-correlated features to a total number of non-correlated features and correlated features, or spatial distribution of said non-correlated features.

11. The method according to claim 10 further comprising the step of:

(f) repeating steps (c), (d), and (e) with respect to successive ones of said images from said camera.

12. The method according to claim 11 further comprising the step of:

(g) determining said camera invalid when a number of consecutive images from said camera image are determined as having an invalid background at step (e).

13. The method according to claim 12 further comprising the step of:

(h) generating an invalid camera alarm when said camera is determined invalid.

14. The method according to claim 12 wherein said camera determined invalid is associated with one of movement of said camera or at least partial blocking of view of said camera of said scene.

15. The method according to claim 10 further comprising the step of:

(i) periodically repeating steps (a) and (b) using another plurality of said images to provide an updated background image and said updated background image represents said background image at steps (d) and (e) with respect to a next successive ones of said images of step (f).

16. The method according to claim 10 wherein said method is carried out by a computer system.

17. The method according to claim 16 wherein said computer system is part of a facility security system.

18. A system for detecting an invalid camera in video surveillance comprising:

a camera for capturing video images of a scene; and a computer system for received said images and determining when said camera represents an invalid camera in accordance with sufficient change occurring in the background of said scene in said images.

19. The system according to claim 18 wherein said computer system to determine when said camera represents an invalid camera periodically generates a background image from a plurality of successive images from the camera, extracts first features of the scene from the periodically generated background image and extracts second features of the scene from current images from the camera, and correlates parts of the last generated background image with corresponding parts from the current images with respect to locations associated with a plurality of said first and second features to determine non-correlated extracted features in the current images, and wherein said camera represents an invalid camera in accordance with one or more of the number, percentage, or spatial distribution of said non-correlated extracted feature in the current images which is associated with sufficient change occurring in the background of the scene.

20. The system according to claim 18 wherein said computer system is part of a facility security system.

21. The system according to claim 18 wherein said computer system generates an invalid camera alarm when said camera is determined invalid.

22. The method according to claim 1 wherein said method is carried out by a computer system.

* * * * *